US008757645B2

(12) United States Patent
Wang

(10) Patent No.: US 8,757,645 B2
(45) Date of Patent: Jun. 24, 2014

(54) GOLF CART HEIGHT ADJUSTMENT DEVICE

(76) Inventor: Jonathan Hwan Wang, Hayward, CA (US)

( * ) Notice: Subject to any disclaimer, the term of this patent is extended or adjusted under 35 U.S.C. 154(b) by 0 days.

(21) Appl. No.: 12/790,824

(22) Filed: May 29, 2010

(65) Prior Publication Data

US 2011/0074126 A1 Mar. 31, 2011

(30) Foreign Application Priority Data

Sep. 29, 2009 (CN) ..... 2009 2 0236583

(51) Int. Cl.
*B62B 3/00* (2006.01)
*A63B 55/00* (2006.01)
*A63B 57/00* (2006.01)

(52) U.S. Cl.
CPC ..... *A63B 57/00* (2013.01); *A63B 55/00* (2013.01); *A63B 2225/093* (2013.01); *Y10S 280/06* (2013.01)
USPC ..... 280/47.371; 280/645; 280/646; 280/651; 280/DIG. 6

(58) Field of Classification Search
USPC ..... 280/645, 646, 651, 652, 655, 655.1, 40, 280/DIG. 6, 47.26
See application file for complete search history.

(56) References Cited

U.S. PATENT DOCUMENTS

| | | | | |
|---|---|---|---|---|
| 5,857,684 | A * | 1/1999 | Liao et al. | 280/40 |
| 6,000,712 | A * | 12/1999 | Wu | 280/639 |
| 6,126,184 | A * | 10/2000 | Liao | 280/47.371 |
| 6,345,836 | B1 * | 2/2002 | Wu | 280/651 |
| 6,561,527 | B2 * | 5/2003 | Spadino | 280/47.26 |
| 6,827,366 | B1 * | 12/2004 | Wu | 280/651 |
| 6,918,604 | B2 * | 7/2005 | Liao | 280/47.26 |
| 6,979,019 | B2 * | 12/2005 | Chen | 280/652 |
| 2003/0132613 | A1 * | 7/2003 | Lin | 280/651 |

* cited by examiner

*Primary Examiner* — Katy M Ebner

(57) ABSTRACT

A height adjustment device, which includes a base, which connects to a main bar of a golf cart, and a sliding block which connects to a handle of the golf cart. There are two parallel arc oriented plates formed on each side of the base, and sliding block on both sides of the location near the opening matching with the corresponding slide guide plate. Movement of the sliding block along the base of the curved guide plate adjusts the angle and position between the sliding block and base. Furthermore, the movement can adjust the angle and position of the handle and the main bar and the overall height of the device. The device is simple, suitable for different groups of people, and may adjust handle height at any time.

8 Claims, 3 Drawing Sheets

GOLF CART HEIGHT ADJUSTMENT DEVICE

BACKGROUND OF THE INVENTION

Golf carts may be pushed or pulled during walking. The position of the handle of the golf cart disposed on the frame of the golf cart often may not be changed, which may present a plurality of problems such as pushing or pulling a golf cart when walking on level ground, walking uphill, walking downhill or accommodating users of different sizes using the golf cart. For each user, the height between the handle of the golf cart and the user may be different, so if the users may not adjust the height of the handle, then it will be an inconvenience for the user. If the golf cart handle height may be adjusted, it will give users more convenience.

DETAILED DESCRIPTION OF THE INVENTION

In general, an embodiment includes a golf cart height adjustment device that may be provided between a handle and a main frame of a golf cart, so that a location of the handle may be height adjustable. The present invention is a golf cart height adjustment device that may facilitate utilization of a golf cart for a plurality of different sized users.

In one embodiment, a golf cart height adjustment device may includes a rod connected to the golf cart height adjustment device, a base, which connects to a main bar of the golf cart, and a slide block which connects to a handle of the golf cart. There is a pair of parallel arc oriented plates formed on each side of the base and a sliding block on both sides approximate to an opening matching a corresponding slide guide plate, wherein the two slide guide plates may be placed in a pair of slide chutes.

In one embodiment, an outside of the guide plate may be a curved guide slot on each side of a chute, the chute on the sliding block may have a convex card block, which is may be located on an inner wall of the chute that slides on the curved guide slot, which corresponds with the convex card block, wherein the card block sits within the curved guide slot. In one embodiment, the bottom of the base may have an open plug-in slot. In one embodiment, the sliding block may have a vertical mounting hole.

In one embodiment, in between the sliding block and the base a lock tight locking block is disposed, which may lock onto the base. The locking block and the sliding block may have a sliding connection and on both sides of a bottom of the locking block may have a card column, where the inside top of the guide plate may have several concave slots which may fit a card column.

In one embodiment, the sliding block and the locking block may have a vertical rail sliding slot. The locking block may be equipped with a guide bar that fits through the vertical rail sliding slot.

In one embodiment, the sliding block and the locking block may have a vertical chamber. The vertical chamber may have a screw and a spring and a threaded end of the screw goes through the vertical chamber and may be fixed to the locking block. The spring may sit between the top of the screw and the vertical chamber.

Figure 1:
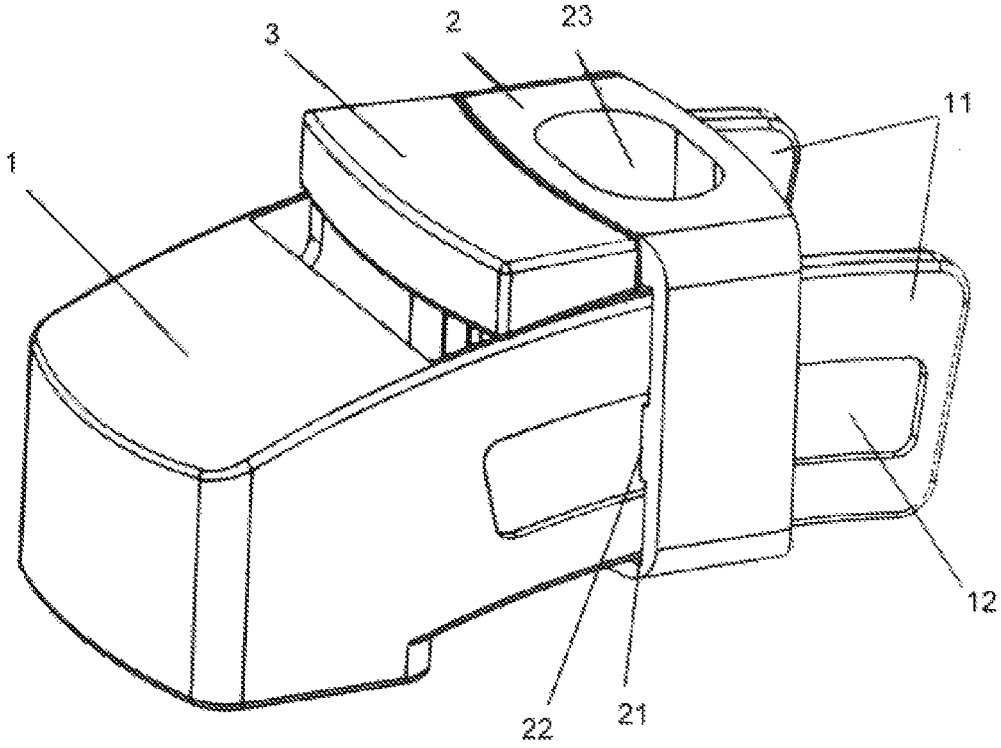
FIG. 1 is a side view of a golf cart height adjustment device in accordance with at least one embodiment.
Figure 2:
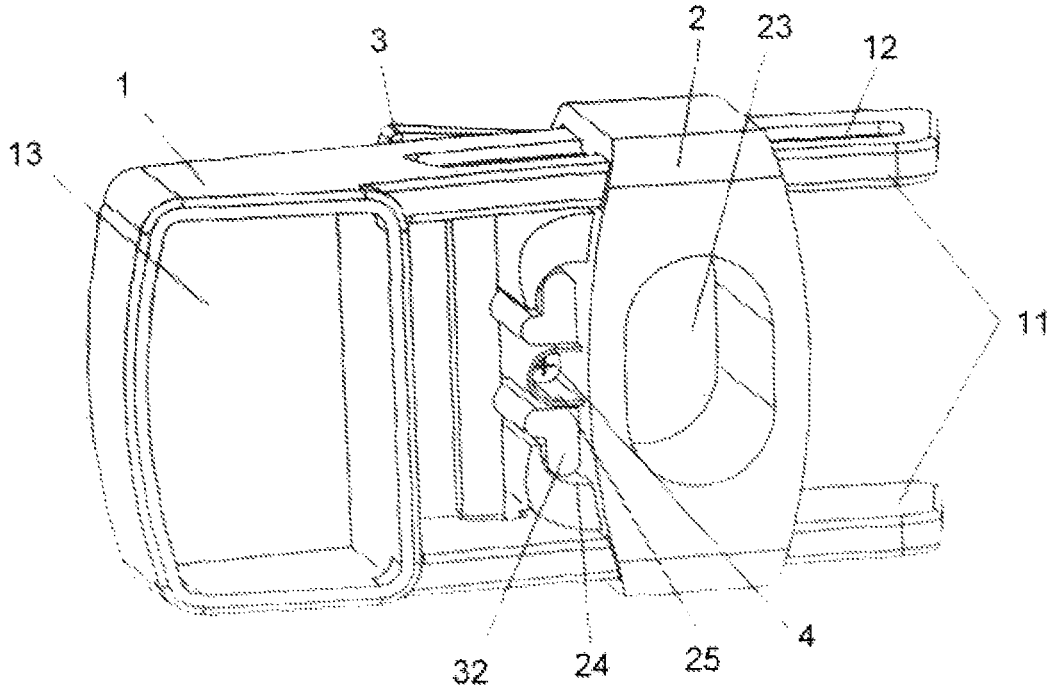
FIG. 2 is a bottom view of a golf cart height adjustment device in accordance with at least one embodiment.

FIG. 1 shows a side view of a golf cart height adjustment device. The golf cart height adjustment device 100 includes a rod (not shown) connected to a base (1), with a handle (not shown) connected to a sliding block (2). FIG. 2 shows a bottom view of a golf cart height adjustment device. The bottom of the base (1) may have an open plug-in slot (13) and the top of the main bar (not shown) may be fixed to the open plug-in slot (13). The sliding block (2) may have a vertical mounting hole (23) that fixes the bottom of the handle.

Coupled to the base (1) may be a pair of guide plates (11). The sliding block (2) may be close to a location of the sides where there may be an opening for two guide plates (11) that correspond to matching the chute (21). The pair of guide plates (11) may slide into the chute (21). The sliding block (2) may slide along within the curved guide slot (12) of the base (1).

The outside of the pair of guide plates (11) may have a curved guide slot (12) on each side of the pair of guide plates (11). The chute (21) on the sliding block (2) may have a convex card block (22), which may be located on the inner wall of the chute (21) that slides on the curved guide slot (12), which corresponds with the convex card block (22), where the convex card block (22) sits within the curved guide slot (12). The matching of the curved guide slot (12) and the corresponding card block (22) allows the sliding of the sliding block (2) to be more stable, and the curved guide slot (12) limits the range of sliding the sliding block (2), to prevent the sliding block (2) from sliding off of the guide plate (11).

In between the sliding block (2) and the base (1) may have a lock tightening block (3), which may lock the sliding block (2) on to the base (1). The locking block (3) and the sliding block (2) may have a sliding connection on both sides of the bottom of the locking block (3) with a card column (31). The inside top of the guide plate (11) may have several concave slots (14) which may fit the card column (31).

Figure 3:
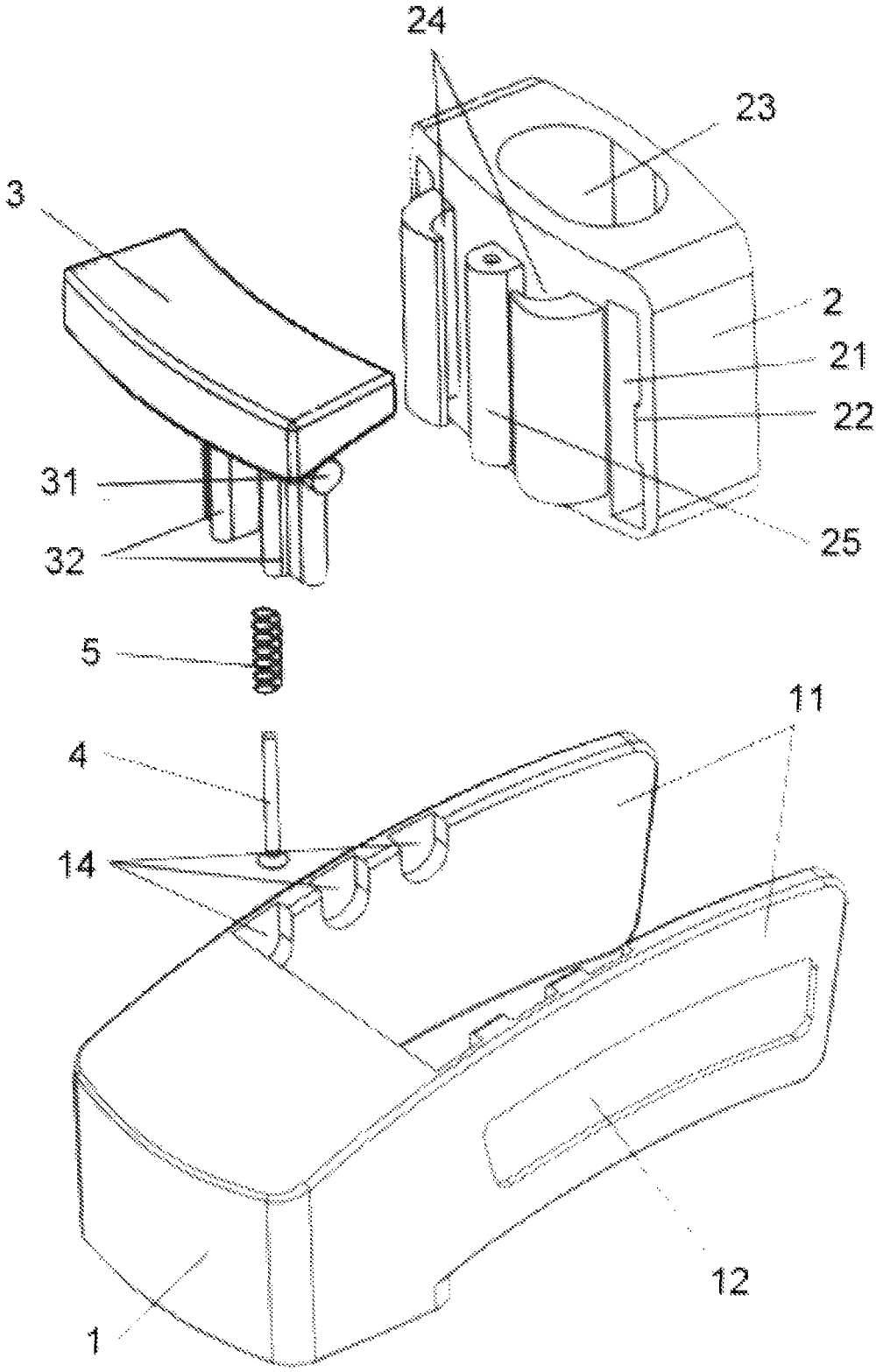
FIG. 3 is an exploded side view of a golf cart height adjustment device in accordance with at least one embodiment.

FIG. 3 is an exploded side view of a golf cart height adjustment device. Several concave slots (14), which may be distributed along the guide plate (11), to form many stopping positions so the card column (31) may stop in any one of these concave slots (14). Based upon the demand of different heights, the card column (31) may stop on the appropriate concave slot (14).

The sliding block (2) and the locking block (3) may have a vertical rail sliding slot (24). The locking block (3) may be equipped with a guide bar (32) that fits through the vertical rail sliding slot (24). The locking block (3) may be equipped with a guide bar (32) that fits through the vertical rail sliding slot (24).

The locking block (3) may vertically slide along with the sliding block (2). The junction of the sliding block (2) and the locking block (3) may be at the vertical chamber (25). The vertical chamber (25) may have a screw (4) and a spring (5), the threaded end of the screw (4) goes through the vertical chamber (25) and may be fixed to the locking block (3). The spring (5) sits between the top of the screw (4) and the vertical chamber (25). When adjusting the height of the golf cart height adjustment device 100, the locking block (3), which activates the spring (5) and creates elastic tension should be pulled up. The sliding block (2) may then be slid into the desired position on the concave slot (14) and finally release the locking block (3), and the elastic spring (5) slides back down. The card column (31) on the locking block (3) may move into the concave slot (14). Furthermore, the locking block (3) and sliding block (2) may be fixed on-to the base (1).

The golf cart height adjustment device 100 promotes the sliding of the sliding block (2) along the base (1) of the curved guide plate (11), that may adjust the angle and position between the sliding block (2) and the base (1). Furthermore, the movement may adjust the angle and position of the handle and the main bar and the overall height of the golf cart height adjustment device 100. The golf cart height adjustment device 100 is simple, suitable for different sized people to use, and has a height adjustable handle that may be adjusted at any time. The golf cart height adjustment device 100 is relatively low cost and may have a relatively long life.

The golf cart height adjustment device may include a base having a first portion with a top, an open bottom, a distal side, a proximal side, a first side, a second side, and a single hollow space opening to the open bottom. The single hollow space may be configured to be operable to a main bar of a golf cart, the base may have a second portion having a first flat plate extending from the first side past the proximal side. The first flat plate may have an exterior side, an interior side, a top side and a bottom side, the top side and the bottom side may have a plurality of arc segments from one or more concentric circles having a center below the bottom side, the second portion may have a second flat plate extending from the second side past the proximal side. The second flat plate may have an exterior side, an interior side, a top side and a bottom side, the top side and the bottom side may have a plurality of arc segments from one or more concentric circles having a center below the bottom side, in which the interior sides of the first plate and the second plate may face. The exterior sides of the first plate and the second plate may each include a curved guide slot, and a first slot and a second slot that may each include a convex member being configured to slide within the curved guide slot. The golf cart height adjustment device may also include a sliding block having a top surface, a bottom surface, a distal surface, a proximal surface, a first surface, a second surface and an aperture. The sliding block extends from the top surface to the bottom surface, the aperture may be configured to be operable to couple to a handle assembly of the golf cart, the sliding block may have a first slot extending from the proximal surface to a distal surface interior to the first surface. The first slot may be configured to slidably accept the first plate, the sliding block may have a second slot extending from the proximal surface to the distal surface interior to the second surface, the second slot may be configured to slidably accept the second plate, in which a height of the handle assembly may be varied by slidable rotation of the sliding block.

The single hollow space may have a generally rectangular shape and the aperture may have a generally oval shape. The golf cart height adjustment device further comprises a locking block slidably joined to the proximal surface of the sliding block, the locking block may have a top portion and a bottom portion. The bottom portion may have a horizontally oriented member, and the interior sides of the first plate and the second plate may each have a plurality of slots extending down from the top side, the plurality of slots may be configured to be operable to engage the horizontally oriented member, in which the sliding block is restrained from movement. The golf cart height adjustment device may have the locking block and the sliding block which may be slidably joined by at least one vertical guide bar and at least one vertical slot. The golf cart height adjustment device further comprises a screw and a spring that may be configured to be retained on a shaft of the screw, the proximal surface of the sliding block having a vertical chamber being configured to pass the shaft, in which the screw joins to the locking block and the spring may be operable to urge the horizontally oriented member to remain in a pair of the plurality of slots. The base may have a first portion with a top, an open bottom, a distal side, a proximal side, a first side, a second side, and a single hollow space opening to the open bottom, the single hollow space may have a generally rectangular shape and may be configured to be operable to join to a main bar of a golf cart, the base may have a second portion with a first flat plate extending from the first side past the proximal side, the first flat plate may have an exterior side, an interior side, a top side and a bottom side, the top side and the bottom side may have a plurality of arc segments from one or more concentric circles having a center below the bottom side. The exterior side may have a curved guide slot disposed between the top side and the bottom side, the interior side may have a plurality of slots extending down from the top side, the second portion may have a second flat plate extending from the second side past the proximal side, the second flat plate may have an exterior side, an interior side, a top side and a bottom side. The top side and the bottom side may have a plurality of arc segments from one or more concentric circles having a center below the bottom side, the exterior side may have a curved guide slot disposed between the top side and the bottom side, the interior side may have a plurality of slots extending down from the top side, in which the interior sides of the first plate and the second plate may face.

There is also a sliding block that may have a top surface, a bottom surface, a distal surface, a proximal surface, a first surface, a second surface and an aperture extending from the top surface to the bottom surface, the aperture may have a generally oval shape and may be configured to be operable to join to a handle assembly of the golf cart, the proximal surface may have a vertical chamber, the sliding block may have a first slot extending from the proximal surface to a distal surface interior to the first surface. The first slot may be configured to slidably accept the first plate, the first slot may have a convex member being configured to slide within the curved guide slot, the sliding block may have a second slot extending from the proximal surface to the distal surface interior to the second surface. The second slot may be configured to slidably accept the second plate, the second slot may have a convex member being configured to slide within the curved guide slot. The golf cart height adjustment device may also include means for locking the sliding block at a position along the first plate and the second plate, in which a height of the handle assembly may be adjusted. The means for locking may be a locking block slidably joined to the proximal surface of the sliding block by at least one vertical guide bar and at least one vertical slot, the locking block may have a top portion and a bottom portion, the bottom portion may have a horizontally oriented member, the horizontally oriented member may be configured to be operable to engage a pair of opposing slots on the interior sides. There may be a screw being configured to pass through the vertical chamber and joining to the locking block and a spring may being configured to be retained on a shaft of the screw between a bottom of the vertical chamber and a head of the screw, in which the spring may be operable to urge the horizontally oriented member to remain in a pair of the plurality of slots, in which a height of the handle assembly may be varied by slidable rotation of the sliding block and locked in place.

While the invention has been described in conjunction with a number of embodiments, it is evident that many alternatives, modifications and variations would be or are apparent to those of ordinary skill in the applicable arts. Accordingly, Applicants intend to embrace all such alternatives, modifications, equivalents and variations that are within the spirit and scope of the invention.

The invention claimed is:

1. A golf cart height adjustment device, comprising:

a base having a first portion with a top, an open bottom, a distal side, a proximal side, a first side, a second side, and a single hollow space opening to said open bottom, said single hollow space configured to be operable to a main bar of a golf cart, said base having a second portion having a first flat plate extending from said first side past said proximal side, said first flat plate having an exterior side, an interior side, a top side and a bottom side, said top side and said bottom side having a plurality of arc segments from one or more concentric circles having a center below said bottom side, said second portion having a second flat plate extending from said second side past said proximal side, said second flat plate having an exterior side, an interior side, a top side and a bottom side, said top side and said bottom side having a plurality of arc segments from one or more concentric circles having a center below said bottom side, in which said interior sides of said first plate and said second plate are facing, said exterior sides of said first plate and said second plate each includes a curved guide slot;

a sliding block having a top surface, a bottom surface, a distal surface, a proximal surface, a first surface, a second surface and an aperture, said sliding block extending from said top surface to said bottom surface, said aperture being configured to be operable to couple to a handle assembly of said golf cart, said sliding block having a first slot extending from said proximal surface to a distal surface interior to said first surface, said first slot being configured to slidably accept said first plate, said sliding block having a second slot extending from said proximal surface to said distal surface interior to said second surface, said second slot being configured to slidably accept said second plate, each of said first slot and said second slot including a convex member being configured to slide within a respective curved guide slot, wherein a height of said handle assembly is varied by slidable rotation of said sliding block; and a locking block slidably joined to said proximal surface of said sliding block.

2. The golf cart height adjustment device as recited in claim 1, in which said single hollow space has a generally rectangular shape.

3. The golf cart height adjustment device as recited in claim 1, in which said aperture has a generally oval shape.

4. The golf cart height adjustment device as recited in claim 1, in which said locking block having a top portion and a bottom portion, said bottom portion having a horizontally oriented member, and said interior sides of said first plate and said second plate each having a plurality of slots extending down from said top side, said plurality of slots being configured to be operable to engage said horizontally oriented member, in which said sliding block is restrained from movement.

5. The golf cart height adjustment device as recited in claim 4, in which said locking block and said sliding block are slidably joined by at least one vertical guide bar and at least one vertical slot.

6. The golf cart height adjustment device as recited in claim 4, further comprising a screw and a spring being configured to be retained on a shaft of said screw, said proximal surface of said sliding block having a vertical chamber being configured to pass said shaft, in which said screw joins to said locking block and said spring is operable to urge said horizontally oriented member to remain in a pair of said plurality of slots.

7. A golf cart height adjustment device, comprising:

a base having a first portion with a top, an open bottom, a distal side, a proximal side, a first side, a second side, and a single hollow space opening to said open bottom, said single hollow space having a generally rectangular shape and being configured to be operable to join to a main bar of a golf cart, said base having a second portion with a first flat plate extending from said first side past said proximal side, said first flat plate having an exterior side, an interior side, a top side and a bottom side, said top side and said bottom side having a plurality of arc segments from one or more concentric circles having a center below said bottom side, said exterior side having a curved guide slot disposed between said top side and said bottom side, said interior side having a plurality of slots extending down from said top side, said second portion having a second flat plate extending from said second side past said proximal side, said second flat plate having an exterior side, an interior side, a top side and a bottom side, said top side and said bottom side having a plurality of arc segments from one or more concentric circles having a center below said bottom side, said exterior side having a curved guide slot disposed between said top side and said bottom side, said interior side having a plurality of slots extending down from said top side, in which said interior sides of said first plate and said second plate are facing;

a sliding block having a top surface, a bottom surface, a distal surface, a proximal surface, a first surface, a second surface and an aperture extending from said top surface to said bottom surface, said aperture having a generally oval shape and being configured to be operable to join to a handle assembly of said golf cart, said proximal surface having a vertical chamber, said sliding block having a first slot extending from said proximal surface to a distal surface interior to said first surface, said first slot being configured to slidably accept said first plate, said first slot having a convex member being configured to slide within said curved guide slot, said sliding block having a second slot extending from said proximal surface to said distal surface interior to said second surface, said second slot being configured to slidably accept said second plate, said second slot having a convex member being configured to slide within said curved guide slot;

a locking block slidably joined to said proximal surface of said sliding block by at least one vertical guide bar and at least one vertical slot, said locking block having a top portion and a bottom portion, said bottom portion having a horizontally oriented member, said horizontally oriented member being configured to be operable to engage a pair of opposing slots on said interior sides;

a screw being configured to pass through said vertical chamber and joining to said locking block; and a spring being configured to be retained on a shaft of said screw between a bottom of said vertical chamber and a head of said screw, in which said spring is operable to urge said horizontally oriented member to remain in a pair of said plurality of slots, in which a height of said handle assembly is varied by slidable rotation of said sliding block and locked in place.

8. A golf cart height adjustment device, consisting of:

a base having a first portion with a top, an open bottom, a distal side, a proximal side, a first side, a second side, and a single hollow space opening to said open bottom, said single hollow space being configured to be operable to join to a main bar of a golf cart, said base having a second portion with a first flat plate extending from said first side past said proximal side, said first flat plate having an exterior side, an interior side, a top side and a bottom side, said top side and said bottom side having a plurality of arc segments from one or more concentric circles having a center below said bottom side, said second portion having a second flat plate extending from said second side past said proximal side, said second flat plate having an exterior side, an interior side, a top side and a bottom side, said top side and said bottom side having a plurality of arc segments from one or more concentric circles having a center below said bottom side, in which said interior sides of said first plate and said second plate are facing, said exterior sides of said first plate and said second plate each includes a curved guide slot;

a sliding block having a top surface, a bottom surface, a distal surface, a proximal surface, a first surface, a second surface and an aperture extending from said top surface to said bottom surface, said aperture being configured to be operable to join to a handle assembly of said golf cart, said sliding block having a first slot extending from said proximal surface to a distal surface interior to said first surface, said first slot being configured to slidably accept said first plate, said sliding block having a second slot extending from said proximal surface to said distal surface interior to said second surface, said second slot being configured to slidably accept said second plate, each of said first slot and said second slot including a convex member being configured to slide within a respective curved guide slot, wherein a height of said handle assembly is varied by slidable rotation of said sliding block;

means for locking said sliding block at a position along said first plate and said second plate, in which said height of said handle assembly is adjusted; and a locking block slidably joined to said proximal surface of said sliding block, said locking block having a top portion and a bottom portion, said bottom portion having a horizontally oriented member, and said interior sides of said first plate and said second plate each having a plurality of slots extending down from said top side, said plurality of slots being configured to be operable to engage said horizontally oriented member, in which said sliding block is substantially restrained from movement.

* * * * *